US008449132B2

(12) United States Patent
Lau

(10) Patent No.: US 8,449,132 B2
(45) Date of Patent: May 28, 2013

(54) HEAD LIGHT

(76) Inventor: Fermi Chi Hung Lau, Kowloon (HK)

( * ) Notice: Subject to any disclaimer, the term of this patent is extended or adjusted under 35 U.S.C. 154(b) by 445 days.

(21) Appl. No.: 12/386,787

(22) Filed: Apr. 22, 2009

(65) Prior Publication Data

US 2010/0271810 A1 Oct. 28, 2010

(51) Int. Cl.
*F21V 21/08* (2006.01)
*F21V 21/084* (2006.01)

(52) U.S. Cl.
USPC ..... 362/105; 362/103; 362/108; 362/106

(58) Field of Classification Search
USPC ..... 362/103, 105–107, 108
See application file for complete search history.

(56) References Cited

U.S. PATENT DOCUMENTS 6,404,651 B1 * 6/2002 Martin et al. ..... 361/801
6,877,875 B2 * 4/2005 Yu et al. ..... 362/105
6,905,223 B2 * 6/2005 Halasz ..... 362/197
7,293,898 B2 * 11/2007 Kumthampinij et al. ..... 362/294
7,513,660 B2 * 4/2009 Spartano et al. ..... 362/373
7,568,812 B1 * 8/2009 Kumthampinij et al. ..... 362/105
7,674,013 B2 * 3/2010 Leslie et al. ..... 362/249.05
2007/0115652 A1 * 5/2007 Simoni ..... 362/103
2007/0159810 A1 * 7/2007 Kim ..... 362/105
2008/0117623 A1 * 5/2008 Tarter ..... 362/106

* cited by examiner

*Primary Examiner* — Robert May
(74) *Attorney, Agent, or Firm* — Raymond Y. Chan; David and Raymond Patent Firm

(57) ABSTRACT

A head light includes a light core, an assembling accessory and a hear gear. The light core includes a light source for generating light. The assembling accessory includes a front casing and a back casing and defines a core cavity within the front and back casings to receive the light core, wherein the front casing has a light window aligning with the light source such that when the light core is supported within the core cavity, the light source is controllably activated to generate the light through the light window, wherein the assembling accessory is a building part that the assembling accessory is adapted for not only being pieced together with the light core for creating a particular ornamental design and light effect of the head light, but also being disassembled to mix and match with an alternated light core for producing different light effects.

7 Claims, 3 Drawing Sheets

HEAD LIGHT

BACKGROUND OF THE PRESENT INVENTION

1. Field of Invention

The present invention relates to a light source, and more particularly to a head light comprising an assembling accessory which is capable of producing different light effects of the head light.

2. Description of Related Arts

A conventional light source, such as a conventional head light, usually comprises a main housing, a lighting arrangement received in the main housing, and an attachment strip extended from the main housing to attach onto a head of the user of the conventional head light. The lighting arrangement usually comprises at least one high intensity light bulb or LED for generating light in the direction of the user's face. Thus, the user is able to wear the head light on his or her head and acquire the desired illumination while performing other activities.

There exist several disadvantages regarding this kind of conventional head light. First, the conventional head light as described above is inflexible in terms of structural operation and adaptability to different work environments. In order to protect the lighting arrangement received in the main housing, the main housing is usually manufactured in such a manner that the lighting arrangement cannot be accessed without breaking the main housing. In other words, the lighting arrangement is not detachable from within the main housing. The main disadvantage of this feature is that when different light effect is desirable or when the lighting arrangement needs repairing, the user of such conventional head light has no option but to purchase another head light which is suitable for his or her particular or intended use. Second, from manufacturing perspective, when the lighting arrangement needs to be sealed within the main housing, the corresponding manufacturing procedures tend to be complicated.

Another disadvantage regarding this kind of conventional head light is that the conventional head light get broken easily after a couple of assembling and disassembling. For example, when people try to open the light core to fix or replace the light source, he or she needs to be open the light casing. However, it is not durable enough for this kind of conventional head light for several assembling or disassembling of use. In other words, the conventional head light having an inflexible structure is only designed for regular use such that it is not allowable for people attach and detach very frequently.

It is necessary to develop a head light to solve the problem as mentioned before to keep the head light convenient and easier to use.

SUMMARY OF THE PRESENT INVENTION

A main object of the present invention is to provide a head light comprising an assembling accessory which is capable of producing different light effects for the head light.

Another object of the present invention is to provide a head light comprising a light core and an assembling accessory for detachably mounting the light core, so that different light cores and assembling accessories can be used in different combinations for producing different light effects of the head light of the present invention. Since the assembling accessories can be optimally selected, the user may utilize the present invention in a wide variety of circumstances.

Another object of the present invention is to provide a head light wherein the light core and the assembling accessory can be separately maintained so as to minimize the maintenance cost of the present invention.

Another object of the present invention is to provide a head light, wherein the structure of the replaceable assembling accessory is simple but practical, so that the manufacturing process of the light core and different assembling accessories can be simplified to the maximum extent.

Accordingly, in order to accomplish the above objects, the present invention provides a head light, comprising:

a light core which comprises a power source compartment for replaceably receiving a power source therein, a light source for generating light, and a light circuit panel having a power contacting side detachably coupling with said power source compartment and a light terminal side electrically coupling with said light source for electrically connecting said light source with said power source;

an assembling accessory, having a standardized size, comprising a front casing and a back casing detachably coupling with each other and defining a core cavity within said front and back casings to receive said light core, wherein said front casing has a light window aligning with said light source such that when said light core is supported within said core cavity, said light source is controllably activated to generate said light through said light window, wherein said assembling accessory is a building part that said assembling accessory is adapted for not only being pieced together with said light core for creating a particular ornamental design and light effect of said head light but also being disassembled to mix and match with an alternated light core for creating different ornamental designs and light effects of said head light; and a head gear providing at said assembling accessory for retaining said light core at a forehead of a user.

These and other objectives, features, and advantages of the present invention will become apparent from the following detailed description, the accompanying drawings, and the appended claims.

DETAILED DESCRIPTION OF THE PREFERRED EMBODIMENT

Figure 1:
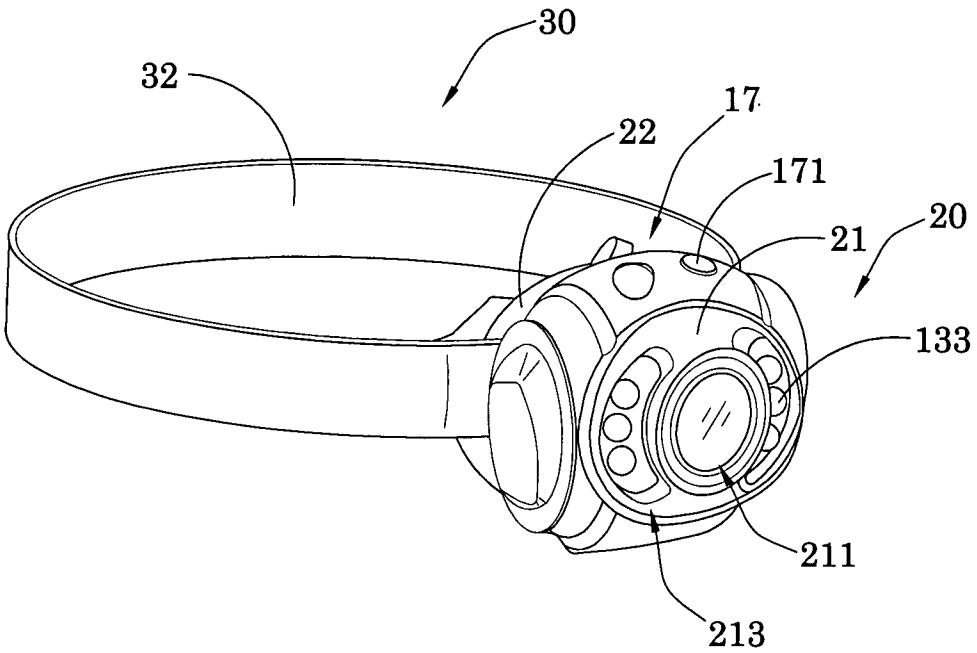
FIG. 1 is a perspective view of a head light according to a preferred embodiment of the present invention.
Figure 2:
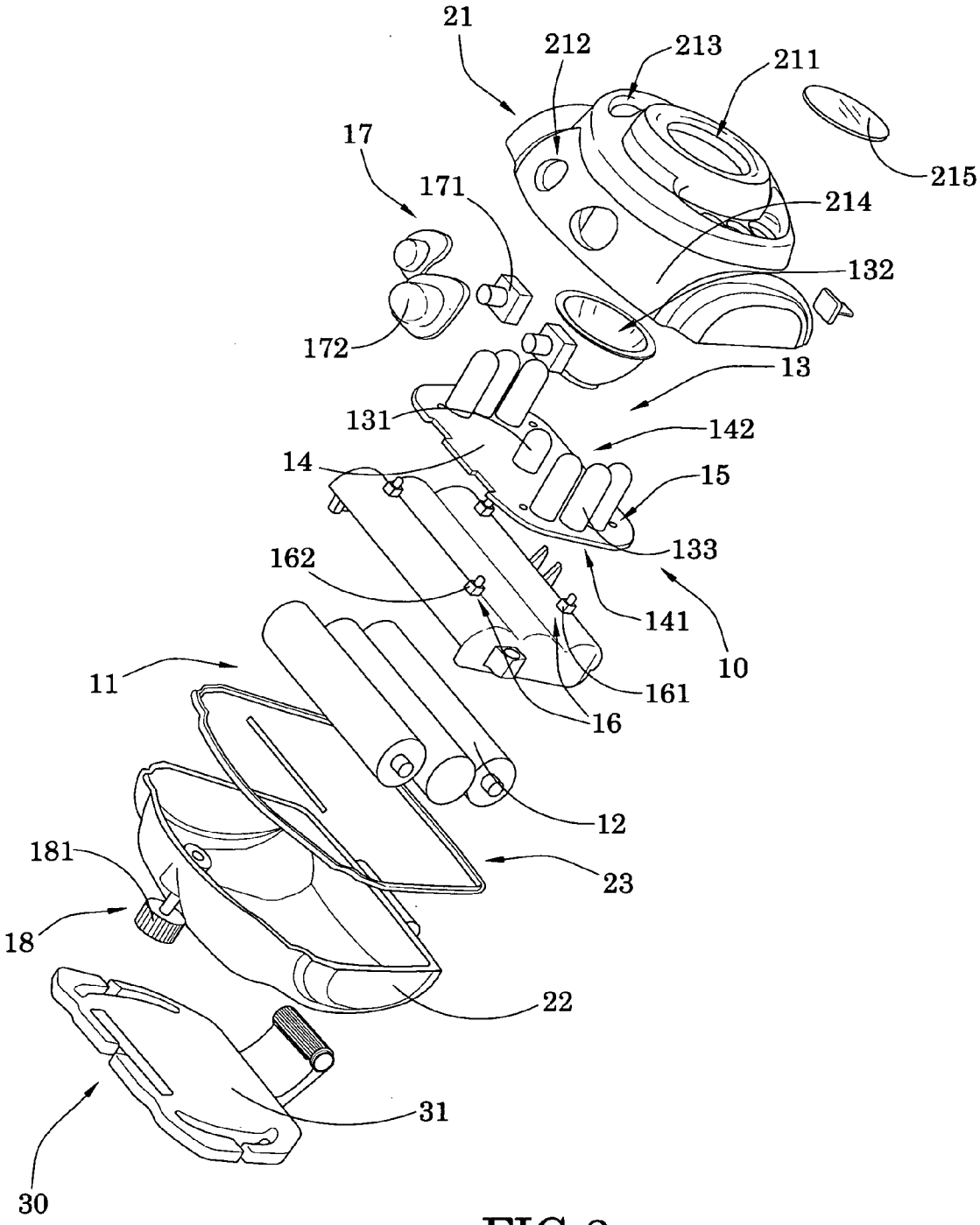
FIG. 2 is an exploded perspective view of the head light according to the above preferred embodiment of the present invention.
Figure 3:
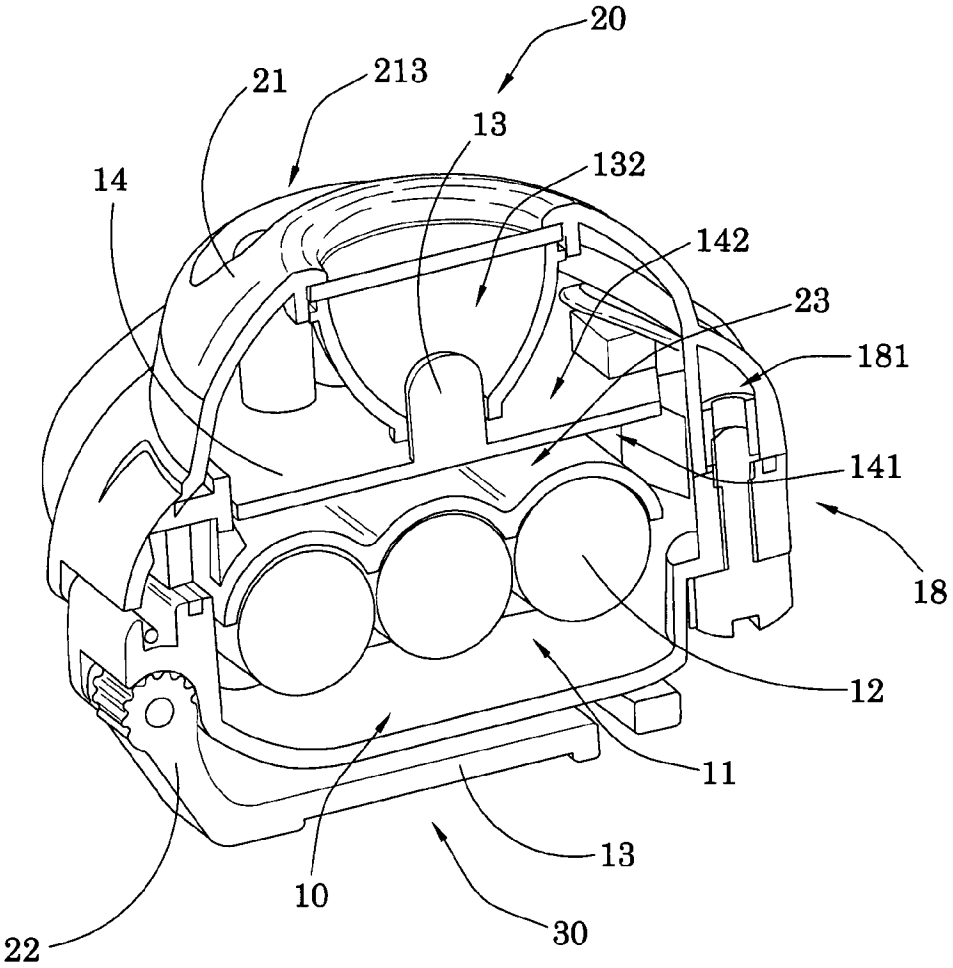
FIG. 3 is a schematic diagram of the head light according to the above preferred embodiment of the present invention illustrating the inner structure of the light core.

Referring to FIG. 1 to FIG. 3 of the drawings, a head light according to a preferred embodiment of the present invention is illustrated, in which the head light comprises a light core 10, an assembling accessory 20, and a head gear 30.

The light core 10 comprises a power source compartment 11 for replaceably receiving a power source 12 therein, a light source 13 for generating light, and a light circuit panel 14 having a power contacting side 141 detachably coupling with the power source compartment 11 and a light terminal side 142 electrically coupling with the light source 12 for electrically connecting the light source 12 with the power source 12.

The assembling accessory 20, having a standardized size, comprises a front casing 21 and a back casing 22 detachably coupling with each other and defining a core cavity 23 within the front casing 21, wherein the front casing 21 has a light window 211 aligning with the light source 12 such that when said light core 10 is supported within the core cavity 23, the light source 12 is controllably activated to generate light through the light window 211, wherein the assembling accessory 20 is a building part that the assembling accessory 20 is adapted for not only being pieced together with the light core 10 for creating a particular ornamental design and light effect of the head light, but also being disassembled to mix and match with an alternated light core 10 for creating different ornamental designs and light effects of the head light.

The head gear 30 is provided at the assembling accessory 20 for retaining the light core 10 on a forehead of a user.

According to the preferred embodiment of the present invention, the light core 10 contains a plurality of terminal slots 15 spacedly formed at the light circuit panel 14 and comprises a plurality of supporting terminals 16 spacedly extended from the power source compartment 11 to couple with the terminal slots 15 respectively so as to not only detachably couple the power source compartment 11 with the light circuit panel 14 but also electrically couple the light circuit panel 14 with the power source 12, such that each of the supporting terminals 16 forms not only a connector to securely mount the power source compartment 11 at the power contacting side 141 of the light circuit panel 14, but also a terminal to electrically connect the light circuit panel 14 with the power source 12.

Moreover, each of the supporting terminals 16 comprises an outer tubular supporter 161 integrally extended from the power source compartment 11 to detachably couple with the power contacting side 141 of the light circuit panel 14, and an inner electrical terminal 162 extended within the tubular supporter 161 to electrically connect a printed circuit of the light circuit panel 14 to the power source 12.

The front casing 21 further contains one or more operation slots 212 spacedly provided thereon for communicating with the core cavity 23, wherein the light core 10 further comprises one or more operation buttons 17 which are electrically coupled with the light circuit panel 14 and are outwardly extended to protrude from the front casing 21 through the operation slots 212 respectively. As a result, the user is able to depress the operation buttons 17 provided on the light core 10 through the operation slots 212 formed on the front casing 21 so as to control the operation of the light core 10. It is worth mentioning that since the operation buttons 17 are provided on the light core 10, so long as the assembling accessory 20 has the operation slots 212 formed on the corresponding positions of the front casing 21, the assembling accessory 20 is replaceable for producing different lighting effect without affecting the operation of the light core 10.

According to the preferred embodiment of the present invention, each of the operation buttons 17 comprises a button body 171 operatively coupled with the light circuit panel 14 to controllably activate the light source 13 and an accessory button sleeve 172 pieced on the button body 171 in a detachable coupling manner. In other words, a user is also able to change different kinds or variety of the accessory button sleeve 172 for imparting the head light with a wide variety of aesthetic appearances.

On the other hand, the light source 13 comprises at least one LED 131 electrically affixed at the light terminal side 142 of the light circuit panel 14 and a reflective bowl 132 detachably supported in the core cavity 23 to align with the light window 211 of the front casing 21 at a position that the LED 131 is encircled within the reflective bowl 132 so that the illumination generated by the LED 131 is effectively and optimally reflected and converged into light having predetermined intensity and propagating direction with respect to the assembling accessory 20. The light source 13 preferably comprises a plurality of LEDs 131 electrically and spacedly affixed at the light terminal side 142 of the light circuit panel 14 to align with the light window 211 of the front casing 21.

In order to further enhance the lighting effect of the present invention, the light source 13 further comprises a plurality of auxiliary LEDs 133 electrically affixed at the light terminal side 142 of the light circuit panel 14 at a position that the auxiliary LEDs 133 are radially arrayed with respect to the LED 131, wherein the front casing 21 further has a plurality of auxiliary light windows 213 aligned with the auxiliary LEDs 133 so that the auxiliary LEDs 133 are capable of delivering auxiliary illumination through the auxiliary light windows 213.

The front casing 21 further comprises a standardized casing body 214 detachably coupling with the back casing 22 and an interchangeable lens 215 defining the light window 211 thereat and detachably coupling with the standardized casing body 214. Thus, manufacturers of the present invention may manufacture different kinds of standardized casing bodies 214 which are capable of detachably attaching to the back casing 22 to form the assembling accessory 20, wherein the user is able to purchase a set of different standardized casing body 214 and choose the most suitable standardized casing body 214 when the user is performing a particular activity. The standardized casing body 214 may be specifically designed for use in certain kinds of user's activities.

In order to allow convenient assembling and disassembling of the assembling accessory 20, the light core 10 comprises a hand-operation attachment 18 which contains a screw hole 181 formed at the front casing 21 and comprises a hand screw 182 provided at the back casing 22 to detachably couple with the screw hole 181 so as to detachably mount the back casing 22 to the front casing 21 in a tool-less and highly convenient manner.

The head gear 30 comprises a rear panel 31 pivotally mounted at a rear side of the back casing 22 for selectively adjusting a light projecting angle of the light core 10 with respect to the rear panel 31, and a size-adjustable wearing loop 32 coupling with the rear panel 31 for adjustably encircling at a head of the user to retain the light core 10 at the forehead of the user.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A head light, comprising:

a light core which comprises a power source compartment for replaceably receiving a power source therein, a light circuit panel having a power contacting side and a light terminal side, a light source affixed at said light terminal side for generating light, a plurality of terminal slots spacedly provided at said power contacting side of said light circuit panel, and a plurality of supporting terminals spacedly extended from said power source compartment, wherein said power source compartment is detachably coupled at said power contacting side of said light circuit panel at a position that said supporting terminals are electrically contacted with said terminal slots respectively to electrically couple said light circuit panel with said power source, wherein each of said supporting terminals comprises an outer tubular supporter integrally extended from said power source compartment to detachably couple with said power contacting side of said light circuit panel, and an inner electrical terminal extended within said tubular supporter to electrically contact with a printed circuit of said light circuit panel with said power source, such that each of said supporting terminals forms not only a connector to detachably contact said power source compartment at said power contacting side of said light circuit panel but also a terminal to electrically connect said light circuit panel with said power source;

an assembling accessory, having a standardized size, comprising a front casing having a light window, a back casing, a hand-operation attachment for detachably mounting said back casing to said front casing in a tool-less manner, an interchangeable lens detachably coupled with said front casing at said light window thereof, wherein said hand-operation attachment contains a screw hole formed at said front casing and comprises a hand screw provided at said back casing to detachably couple with said screw hole so as to detachably mount said back casing to said front casing in a tool-less manner, wherein a core cavity is defined within said front and back casings to detachably receive said light core at a position that said light source is aligned with said light window such that when said light core is supported within said core cavity, said light source is controllably activated to generate said light through said light window, wherein said assembling accessory is a building part that not only said assembling accessory that said front and back casings are detachably coupled via said hand-operation attachment in order to create a particular ornamental design, but also said light core is detachably supported within said core cavity while said power source compartment is detachably coupled at said light circuit panel to be disassembled to mix and match with an alternate light core in order to create different ornamental designs and light effects of said head light; and a head gear provided at said assembling accessory for retaining said light core at a forehead of a user, wherein said head gear comprises a rear panel pivotally mounted at a rear side of said back casing to selectively adjust a light projecting angle of said light core with respect to said rear panel and a size-adjustable wearing loop coupling with said rear panel for adjustably encircling at a head of said user to retain said light core at said forehead of said user.

2. The head light, as recited in claim 1, wherein said front casing further contains one or more operation slots for communicating with said core cavity, wherein said light core further comprises one or more operation buttons which are electrically coupled with said light circuit panel and are outwardly extended to protrude from said front casing through said operation slots respectively.

3. The head light, as recited in claim 2, wherein each of said operation buttons comprises a button body operatively coupled with said light circuit panel to controllably activate said light source and an accessory button sleeve pieced on said button body in a detachable coupling manner.

4. The head light, as recited in claim 3, wherein said light source comprises a LED electrically affixed at said light terminal side of said light circuit panel and a reflective bowl detachably supported in said core cavity to align with said light window of said front casing at a position that said LED is encircled within said reflective bowl.

5. The head light, as recited in claim 4, wherein said light source further comprises a plurality of auxiliary LEDs electrically affixed at said light terminal side of said light circuit panel at a position that said auxiliary LEDs are radially arrayed with respect to said LED, wherein said front casing further has a plurality of auxiliary light windows aligned with said auxiliary LEDs.

6. The head light, as recited in claim 1, wherein said light source comprises a LED electrically affixed at said light terminal side of said light circuit panel and a reflective bowl detachably supported in said core cavity to align with said light window of said front casing at a position that said LED is encircled within said reflective bowl.

7. The head light, as recited in claim 6, wherein said light source further comprises a plurality of auxiliary LEDs electrically affixed at said light terminal side of said light circuit panel at a position that said auxiliary LEDs are radially arrayed with respect to said LED, wherein said front casing further has a plurality of auxiliary light windows aligned with said auxiliary LEDs.

* * * * *